US006254064B1

(12) United States Patent
Gibbs

(10) Patent No.: US 6,254,064 B1
(45) Date of Patent: Jul. 3, 2001

(54) ORNAMENTAL RING FOR FENCE

(76) Inventor: Edward L. Gibbs, P.O. Box 581000, Tulsa, OK (US) 74158-1000

( * ) Notice: Subject to any disclaimer, the term of this patent is extended or adjusted under 35 U.S.C. 154(b) by 0 days.

(21) Appl. No.: 09/313,380

(22) Filed: May 18, 1999

(51) Int. Cl.[7] ..... B21F 27/00
(52) U.S. Cl. ..... 256/22; 256/21; 256/59
(58) Field of Search ..... 256/21, 22, 65, 256/67, 59

(56) References Cited

U.S. PATENT DOCUMENTS

| | | | | |
|---|---|---|---|---|
| 7,774 | * | 11/1850 | Krauser et al. | 256/21 |
| 513,137 | * | 1/1894 | Phelps | 256/21 |
| 737,574 | * | 9/1903 | Burnell . | |
| 1,664,080 | * | 3/1928 | Mapson | 256/22 |
| 2,823,014 | * | 2/1958 | Schrage | 256/21 |
| 5,443,244 | * | 8/1995 | Gibbs | 256/22 |

* cited by examiner

*Primary Examiner*—Lynne H. Browne
*Assistant Examiner*—Tomlyne A Malcolm
(74) *Attorney, Agent, or Firm*—William S. Dorman

(57) ABSTRACT

An ornamental ring for a picket fence of the type having at least one horizontally extending rail being a top rail and at least one other horizontally extending rail being an intermediate rail spaced slightly below the top rail, and having a plurality of spaced vertical pickets connected to the rails such that the pickets extend through the rails and form rectangular openings with the upper rail and the intermediate rail, each rail having a top wall and an inner bottom wall spaced from the top wall so as to form a relatively narrow raceway wherein a retaining rod passes through each raceway of each rail and through openings in the pickets to retain the pickets in position, a ring filling each rectangular opening, each ring having a vertical tang extending upwardly from the top of the ring and through a slotted opening in the inner bottom wall of the top rail, each ring having a rectangular ear projecting downwardly from the bottom of the ring and extending into a slotted opening in the top wall of the intermediate rail, each tang having an opening so as to receive the retaining rod which passes through the raceway of the top rail, each ear having an opening for receiving the retaining rod which passes through the raceway of the intermediate rail.

3 Claims, 5 Drawing Sheets

ORNAMENTAL RING FOR FENCE

BACKGROUND OF THE INVENTION

1. Field of the Invention

This invention relates to an ornamental ring adapted to be positioned between a pair of spaced upper rails and a plurality of vertical pickets where the pickets and rails intersect in such a manner as to form square openings. More particularly, the present invention relates to the design and method of attachment of the ring to the fence assembly in these square openings.

2. Prior Art

The present invention involves an improvement over prior U.S. Pat. No. 5,443,244 Issued on Aug. 22, 1995 for "Rolled Metal Fence Rail". In the aforementioned patent, the fence assembly includes an upper rail, a lower rail and a plurality of vertical pickets. For the purpose of the present invention it will be considered that a third horizontal rail is positioned slightly below and parallel to the upper horizontal rail so as to form square openings between the rails and the adjacent pickets. It has been known in the past to place rings in these rectangular openings, but these are generally attached by welding or other means which do not suggest the manner of attachment disclosed and claimed herein.

SUMMARY OF THE INVENTION

The present invention involves a ring which is designed to be received in the square openings adjacent the top of a fence assembly, where the rails are constructed in the manner set forth in prior U.S. Pat. No. 5,443,244, referred to above. The fence rails include an upper rail, a lower rail and an intermediate rail which is located slightly below the upper rail and parallel thereto. The pickets are attached to the rails in the same manner as set forth in the aforementioned patent. That is, the rails are themselves constructed in such a way that there is a raceway between a top wall and an inner bottom wall on each rail; a rod extends through the raceway and through holes in the pickets which protrude through the rails. The ring of the present invention is designed with a vertical tang at the top of the ring and a rectangular ear at the bottom of the ring. The tang will project upwardly through an opening in the inner bottom wall of the upper rail, whereas the ear will extend downwardly through a slotted opening in the top wall of the intermediate rail. The rods which are used to hold the pickets will also pass through holes in the tang and ear, respectively, to hold the rings in position in the rectangular openings.

DETAILED DESCRIPTION OF THE PREFERRED EMBODIMENTS

Figure 1:
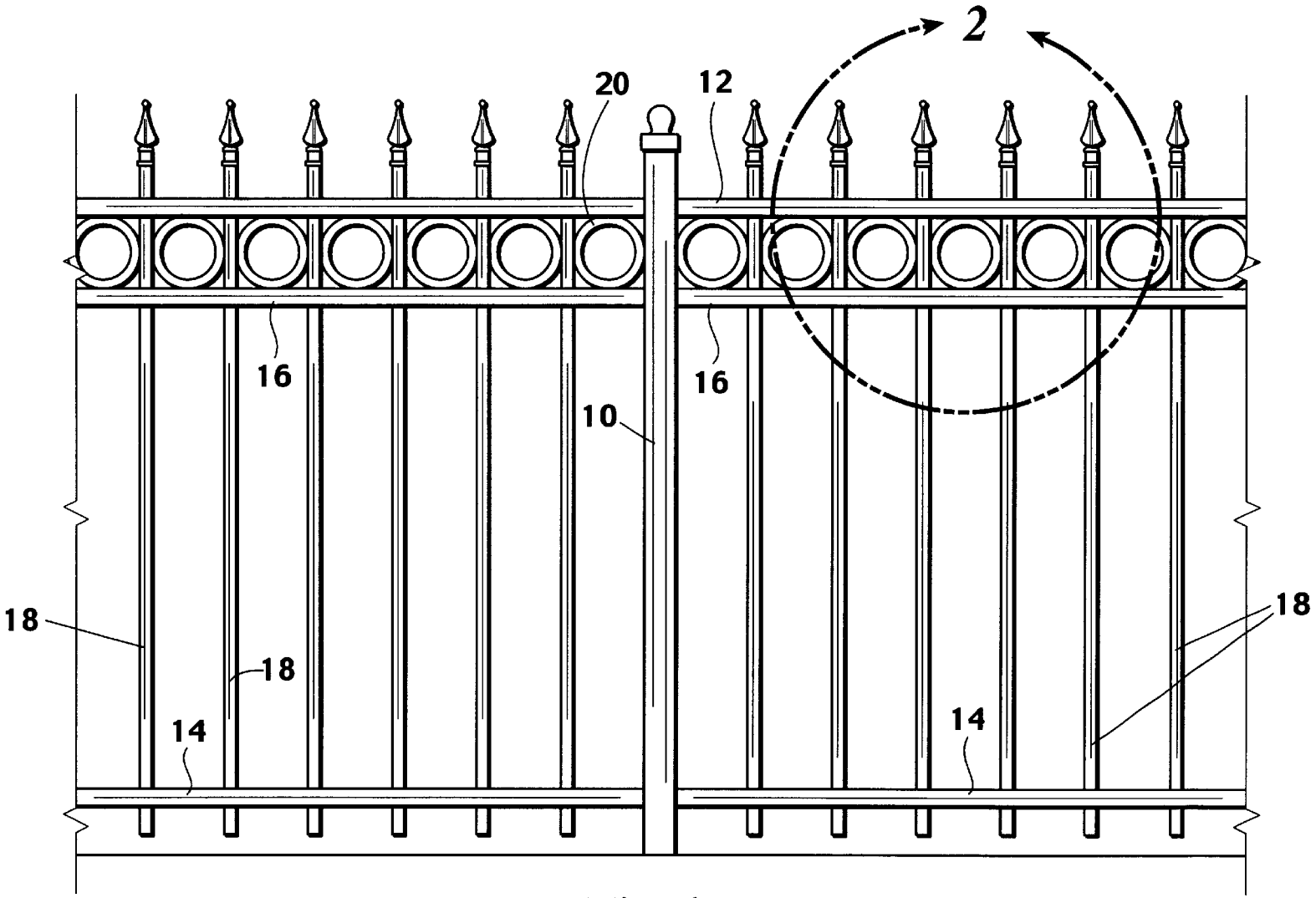
FIG. 1 is a front elevation of a portion of a fence showing the rings of the present invention.
Figure 2:
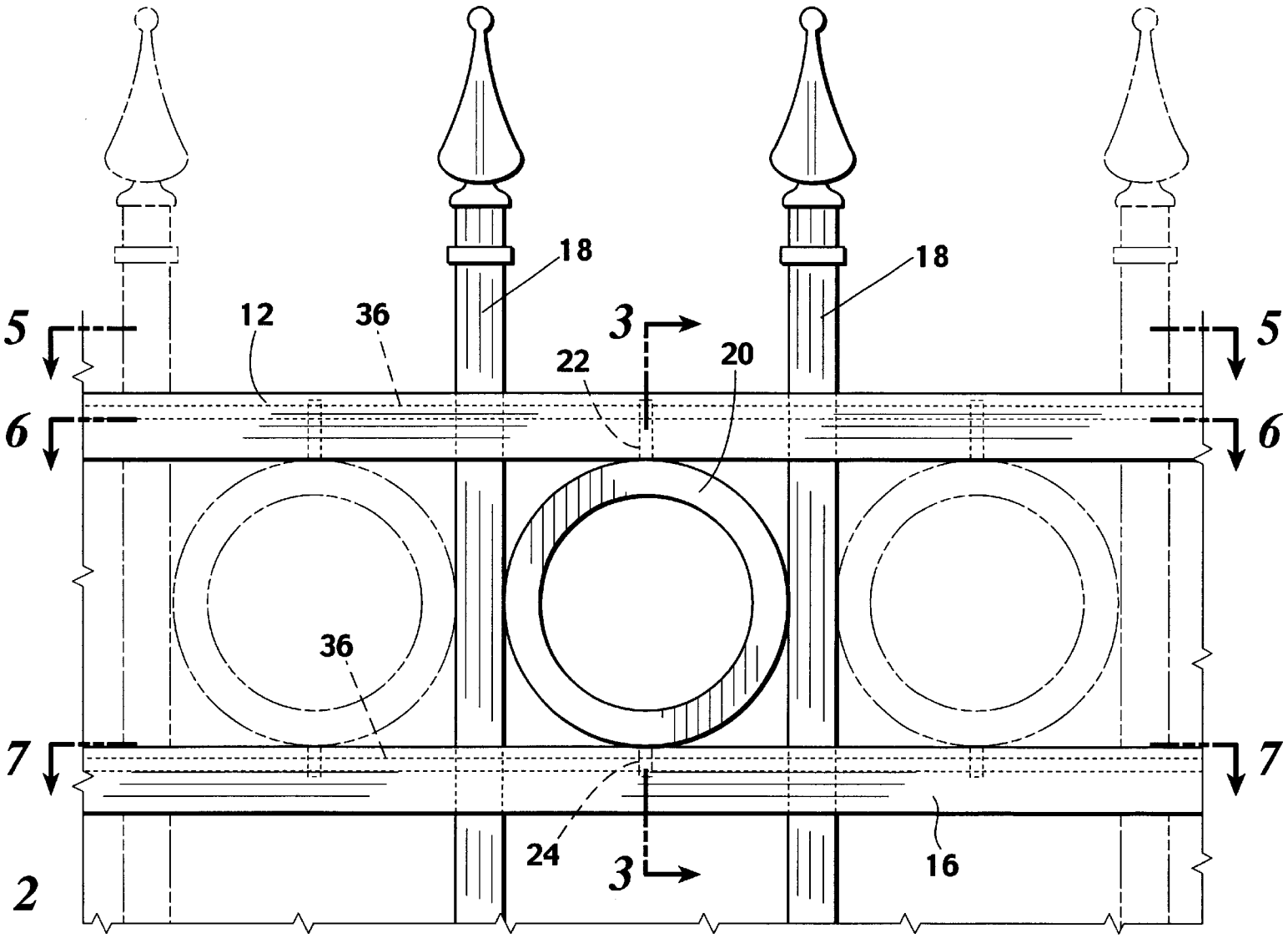
FIG. 2 is an enlargement, with certain portions in phantom and certain portions in dotted lines, of the portion shown in the circled line 2 of FIG. 1.
Figure 4:
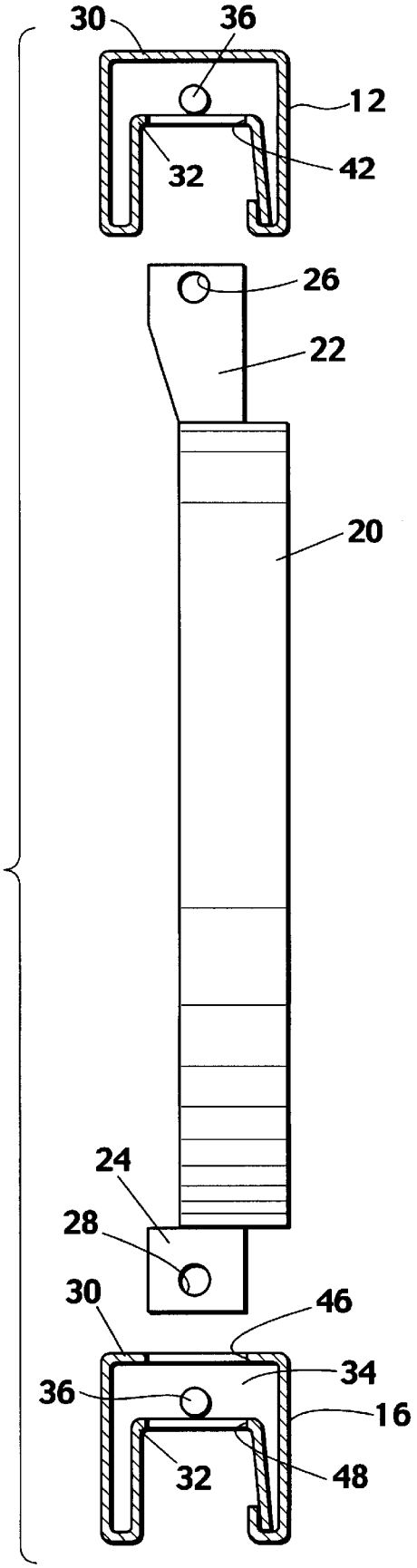
FIG. 4 is an exploded view of the elements shown in FIG. 3.

Referring to the drawings in detail, FIG. 1 shows a fence assembly which includes a vertical fence post 10 and a plurality of horizontal rails including, for example, an upper rail 12 a lower rail 14 and an intermediate rail 16 which is disposed slightly below and in parallel relation to the upper rail 12. A plurality of vertical pickets 18 connect with the horizontal rails in a manner later to be described and also in the manner set forth in the prior patent referred to above. It should appear from a consideration of the geometry of FIG. 1 that the pickets 18 intersect with the upper rail 12 and the third rail 16 in such a manner as to form square openings or apertures. These square openings are occupied by the ring 20 of the present invention.

As best shown in FIGS. 3, 4, 9 and 10, each ring has an upper tang 22 and a lower ear 24. The tang has a hole 26 therein and the ear has a hole 28 therein. These holes 26 and 28 are adapted to receive rods therethrough as will hereinafter appear.

The horizontal rails 12, 14 and 16 disclosed herein can all be described as "Rolled Metal Fence Rails" which are constructed in the same manner as, or in a manner very similar to, the manner in which the horizontal fence rails are constructed in prior U.S. Pat. No. 5,443,244. Attention should also be directed to the manner in which the pickets in prior U.S. Pat. No. 5,443,244 are connected to the horizontal rails by means of rods 44 described therein and which pass through holes in the pickets. The same arrangement is provided in this application for the connection of the pickets 18 to the rails 12, 14, and 16.

The rails 12, 14, and 16 shown in FIG. 1 are made in accordance with the description set forth in U.S. Pat. No. 5,443,244. Briefly stated, each rail is described as being formed by a single metal sheet which has been rolled to enclose an upside down and generally U-shaped channel or space. It should be apparent from a consideration of FIG. 8 of this application that the ends of the rails 12 and 16 each form a generally U-shaped channel or space. The description in the patent goes on to describe this space in terms of a plurality of interconnecting walls. For the purposes of this application it is merely necessary to describe two of the walls referred to in the prior patent; that is, the top transverse wall 30 and the inner bottom wall 32 which is spaced downwardly and parallel with the top wall 30.

Consistent with the description in the prior patent, the space between each upper wall 30 and each associated inner bottom wall 32 is described as a raceway 34 through which a horizontal rod 36 passes. Pickets 18 pass through rectangular openings 38 in the top wall 30 and through rectangular openings 40 in the inner bottom wall 32. The holes 38 are substantially the same size and shape as the cross-sectional shape of the pickets 18, whereas the openings 40 are somewhat extended in the longitudinal direction of the rails themselves so that the pickets can cant as described in the patent. In any event, the rod 36 passes through holes 41 in the pickets to hold them in the position shown. This is also true of the lower rod 36 shown in FIG. 8 which passes through the raceway of the rail 16 and also with respect to the lower most rail 14 (the details of which are not shown).

Figure 5:
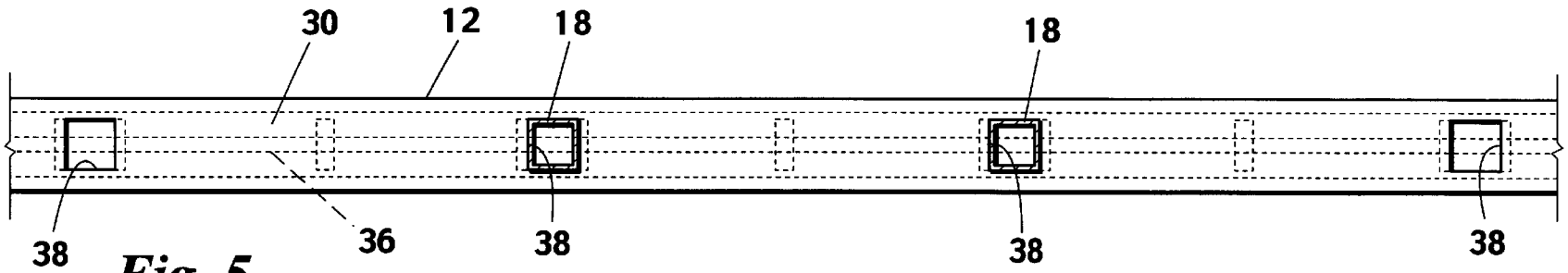
FIG. 5 is a vertical sectional view taken along section line 5—5 of FIG. 2.

Thus, FIG. 5, which shows the top wall 30 of the rail 12, also shows the pickets 18 passing through the rectangular openings 38 which are substantially the same in cross-section as the picket itself.

Figure 6:
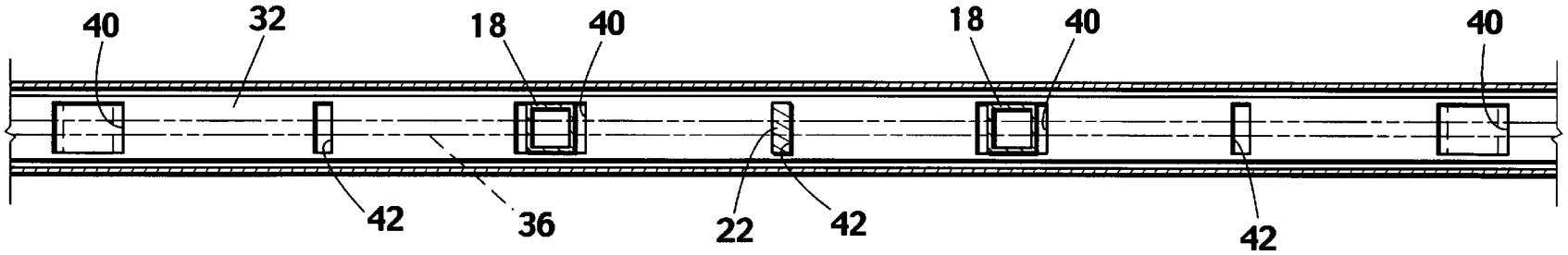
FIG. 6 is a vertical sectional view taken along section line 5—5 of FIG. 2.

FIG. 6, which is a sectional view above the inner bottom wall 32, shows the pickets 18 passing through the elongated openings 40. It should be apparent that the height of the openings 40 is substantially equal to the thickness of the pickets 18 but that, lengthwise, there is a space provided on either transverse side of the picket 18 whereby the picket can cant in the event that the rails 12 and 16 are inclined slightly with respect to the horizontal.

Figure 8:
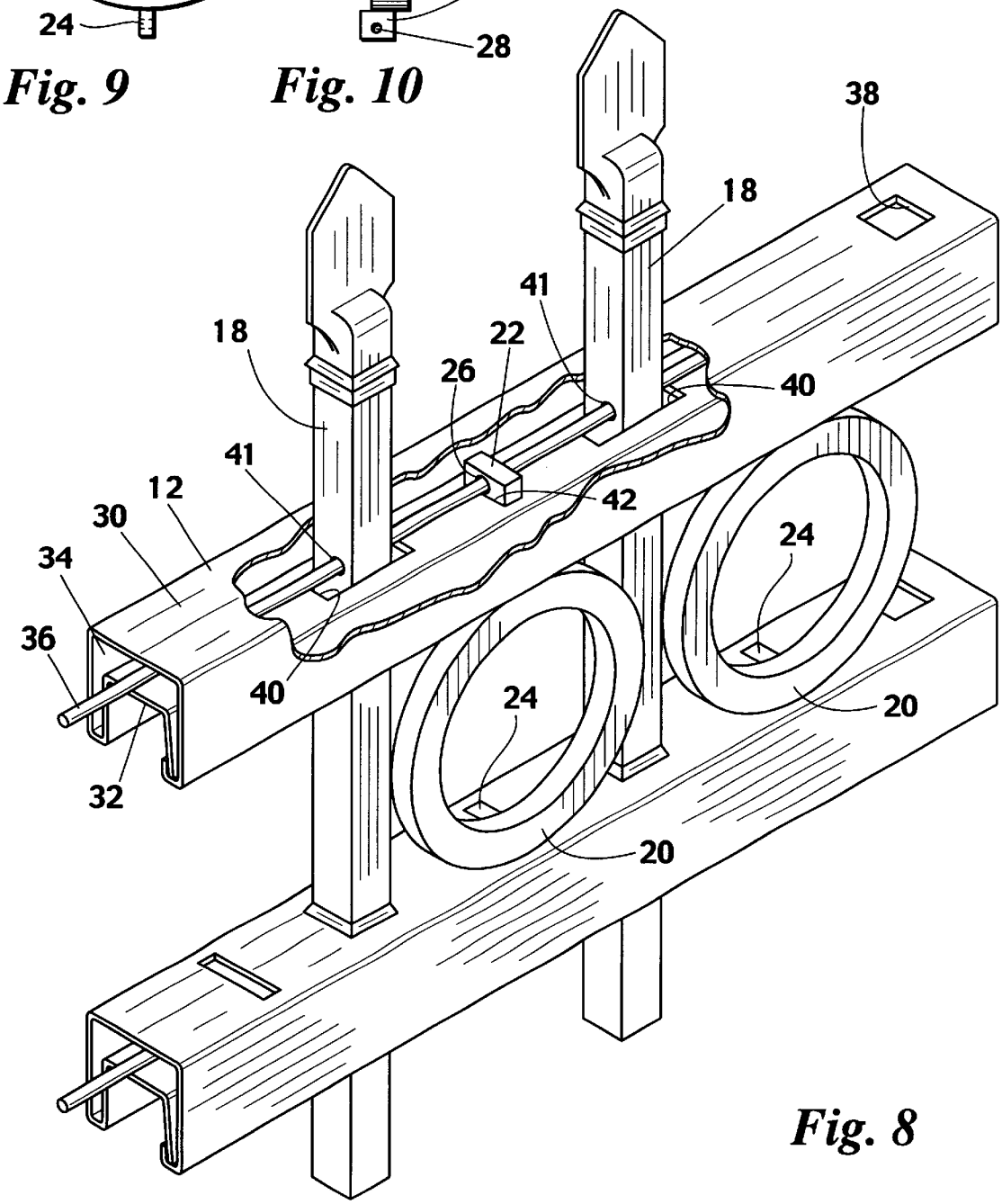
FIG. 8 is a perspective view of the elements shown in FIG. 2 and with parts broken away to show how the ring connects into the assembly using the same rod that passes through the pickets.

For the purpose of providing a means of attachment of the ring 20 to the rail 12, the inner bottom wall 32 is provided with slotted openings 42 having the same cross-sectional shape as that of the tang 22 on ring 20. As best shown in FIG. 8, the tang 22 extends upwardly through the opening 42 in the inner bottom member 32 and below the bottom surface of the top wall 30. The rod 36 is adapted to pass through the hole 26 in the tang 22. Please note that the tang 22 is somewhat offset so that the forward face of the ring 20 will be substantially coplanar with the forward faces of the rails 12 and 16.

Figure 3:
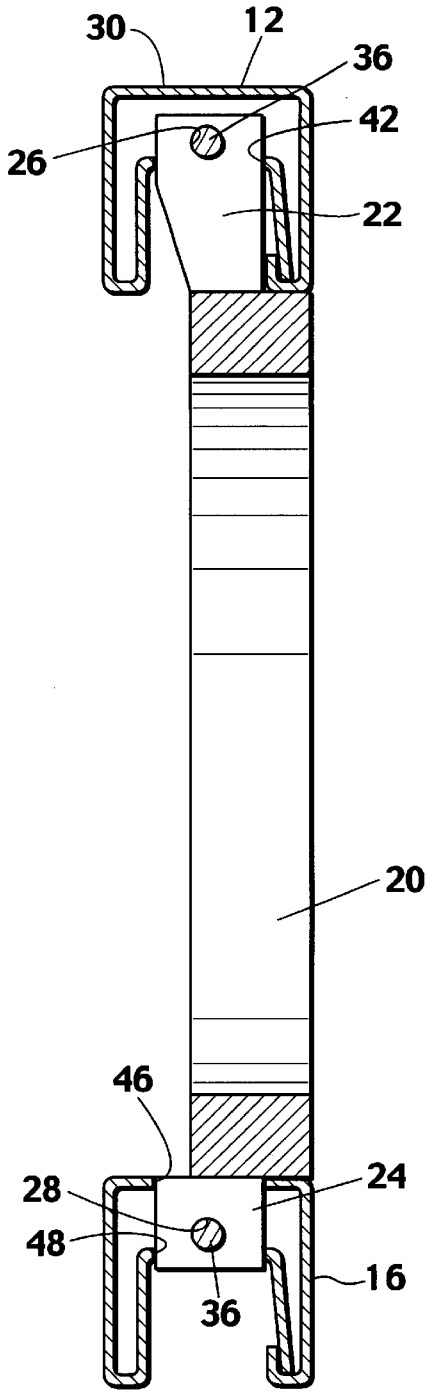
FIG. 3 is a vertical sectional view taken along section line 3—3 of FIG. 2.
Figure 7:
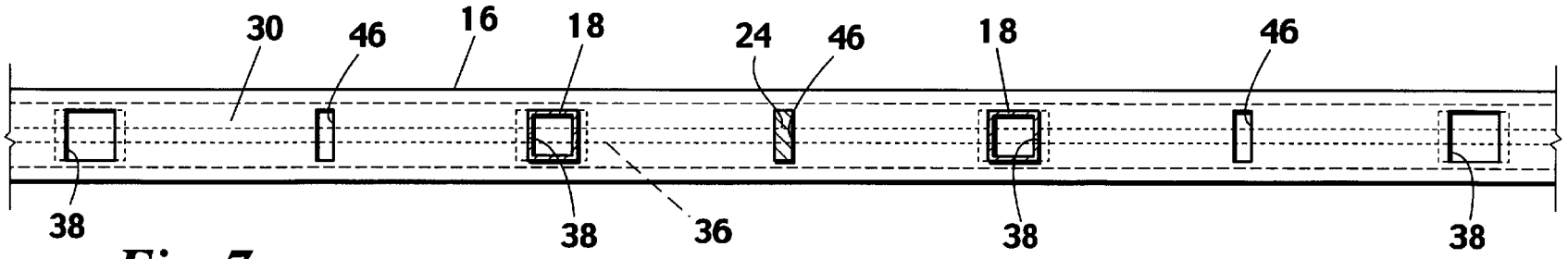
FIG. 7 is a vertical sectional view taken along section line 5—5 of FIG. 2.
Figure 9:
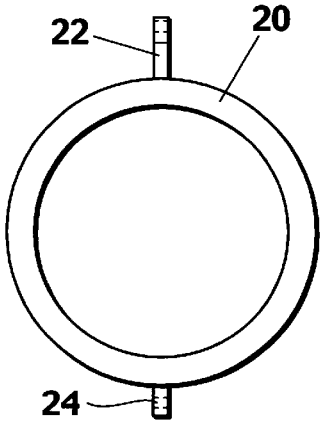
FIG. 9 is a front view of the ring itself.
Figure 10:
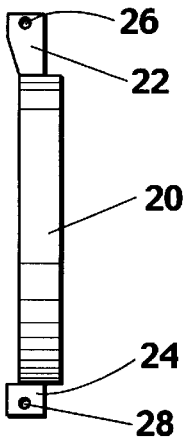
FIG. 10 is a side view of the ring shown in FIG. 9.

Turning now to FIGS. 7 and 8, the top wall 30 of the rail 16 is provided with rectangular openings 46 which are substantially the same size as the openings 42 but which are designed to receive the lower ear 24 on the ring 20. The same considerations hold true for the ear 24 as is the case with the tang 22 for the offset condition. That is, the ear 24 is offset to the rear so that it will be in alignment with the tang 22 to provide a coplanar alignment of the front faces of the ring 20 with the front faces of the rails 12 and 16, as best shown in FIG. 3. In the event that the vertical height of the ear 26 exceeds the height of the raceway 34 between the top wall 30 and the inner bottom wall 32, it may be necessary to provide the inner bottom wall 32 of the rail 16 with another opening 48 directly below the opening 46 in the top wall 30. At any event, the rod 36 which passes through the raceway 34 of the rail 16 will pass through the holes 41 in the adjacent pickets 18 and also through the hole 28 in the ear 24.

It should be noted that the slotted openings 42 in the inner bottom wall 32 are equidistant from the openings 40 through which the pickets 18 pass; the same considerations hold true for the slotted openings 46; that is these slotted openings 46 are equidistant between the square openings 38 in the top wall 30 of the rail 16.

Whereas the present invention has been described in particular relation to the drawings attached hereto, it should be understood that other and further modifications, apart from those shown or suggested herein, may be made within the spirit and scope of this invention. For example, although FIG. 1 shows only a single fence post 10 it should be understood that there will be plurality of fence posts involved in any fence assembly. Each fence section will be supported between a pair of parallel vertical fence posts.

What is claimed is:

1. An ornamental ring for a picket fence having at least one horizontally extending rail being a top rail and at least one other horizontally extending rail being an intermediate rail spaced slightly below the top rail, and having a plurality of spaced vertical pickets connected to the rails such that the pickets extend through the rails and form rectangular openings with the top rail and the intermediate rail, each rail having a top wall and an inner bottom wall spaced from the top wall so as to form a relatively narrow raceway wherein a retaining rod passes through each raceway of each rail and through openings in the pickets to retain the pickets in position, a ring filling each rectangular opening, each ring having a vertical tang extending upwardly from the ring and through a slotted opening in the inner bottom wall of the top rail, each ring having an ear projecting downwardly from the ring and extending into a slotted opening in the top wall of the intermediate rail, each tang having an opening so as to receive the retaining rod which passes through the raceway of the top rail, each ear having an opening for receiving the retaining rod which passes through the raceway of the intermediate rail, the retaining rod which is received within the opening of the tang passing through the tang at right angles thereto, the retaining rod which is received within the opening of the ear passing through the ear at right angles thereto.

2. An ornamental ring for a picket fence having at least three parallel, spaced apart, and horizontally extending rails supported by spaced vertical posts, at least one horizontally extending rail being a top rail and at least one other horizontally extending rail being an intermediate rail spaced slightly below the top rail, and having a plurality of spaced vertical pickets connected to the rails such that the pickets extend through the rails and form rectangular openings with the top rail and the intermediate rail, each rail consisting of a metal sheet which has been rolled to enclose an upside down U-shaped channel, each rail having a top wall and an inner bottom wall spaced from the top wall so as to form a relatively narrow raceway wherein a retaining rod passes through each raceway of each rail and through openings in the pickets to retain the pickets in position, a ring filling each rectangular opening, each ring having an outer diameter substantially equal to the distance between adjacent pickets, each ring having a vertical tang extending upwardly from the ring and adapted to pass through a slotted opening in the inner bottom wall of the top rail, each ring having a rectangular ear projecting downwardly from ring and extending into a slotted opening in the top wall of the intermediate rail, each tang having an opening therethrough so as to receive therethrough a retaining rod which passes through the raceway of the top rail, each ear having an opening for receiving therethrough the retaining rod which passes through the raceway of the intermediate rail, the retaining rod which is received within the opening of the tang passing through the tang at right angles thereto, the retaining rod which is received within the opening of the ear passing through the ear at right angles thereto.

3. An ornamental ring as set forth in claim 2 wherein the openings through the tang and the ear are offset with respect to the ring so that a forward face of the ring is coplanar with forward faces of the top rail and the intermediate rail.

* * * * *